US005425153A

United States Patent [19]

Vosbikian

[11] Patent Number: 5,425,153

[45] Date of Patent: Jun. 20, 1995

[54] BROOM DUSTPAN AND COMBINATION

[75] Inventor: Peter S. Vosbikian, Moorestown, N.J.

[73] Assignee: Quickie Manufacturing Corporation, Cinnaminson, N.J.

[21] Appl. No.: 216,635

[22] Filed: Mar. 23, 1994

Related U.S. Application Data

[63] Continuation-in-part of Ser. No. 21,201, Feb. 23, 1993, Pat. No. 5,367,737.

[51] Int. Cl.[6] ..... A47L 13/52

[52] U.S. Cl. ..... 15/257.2; 15/257.7; 294/53.5

[58] Field of Search ..... 15/257.1, 257.2, 257.7; 294/53.5

[56] References Cited

U.S. PATENT DOCUMENTS

| | | | |
|---|---|---|---|
| 261,894 | 8/1882 | Albers . | |
| 316,810 | 4/1885 | Niebel . | |
| D. 345,238 | 3/1994 | Berti | D32/74 |
| 601,678 | 4/1898 | Richter . | |
| 958,255 | 5/1910 | Koertner . | |
| 1,055,265 | 3/1913 | Gibson | 15/257.7 |
| 1,500,132 | 3/1923 | Hummelgard . | |
| 1,562,892 | 11/1925 | Koertner . | |
| 1,579,279 | 4/1926 | Cave | 15/257.2 |
| 1,989,810 | 2/1935 | Kregeloh | 248/29 |
| 2,098,609 | 11/1937 | Bishop | 306/13 |
| 2,849,743 | 9/1958 | McFarland | 15/257.2 |
| 3,018,502 | 1/1962 | Lossius | 15/257.2 |
| 3,456,663 | 7/1969 | Blum | 294/1.4 |
| 3,733,636 | 5/1973 | Osadsky | 15/257.2 |
| 4,109,338 | 8/1978 | Mertes | 15/105 |
| 4,264,095 | 4/1981 | Lemasters | 294/53.5 |
| 4,584,735 | 4/1986 | Garber | 15/257.7 |

FOREIGN PATENT DOCUMENTS

| | | | |
|---|---|---|---|
| 0156527 | 10/1985 | European Pat. Off. | 15/257.1 |
| 382658 | 8/1990 | European Pat. Off. | A47L 13/52 |
| 26710 | 12/1953 | Finland | 15/257.7 |
| 1114554 | 11/1954 | France . | |
| 542248 | 1/1932 | Germany . | |
| 687044 | 1/1940 | Germany . | |

*Primary Examiner*—David A. Scherbel
*Assistant Examiner*—Randall E. Chin
*Attorney, Agent, or Firm*—Eckert Seamans Cherin & Mellott

[57] ABSTRACT

A dust pan assembly has a bracket coupled to the rear of the dust pan scoop for pivotally receiving an elongated handle, wherein the handle can pivot and lock between at least two positions. In a first position the handle and scoop are inclined, for gathering debris. In a second position the handle and scoop are extended for shovel-like disposal of debris gathered therein and for optimal-storage and display. The dust pan assembly can have clamping means on one or both of the handle and the bracket for receiving a broom, whereby the dust pan assembly and the broom for use therewith are attached as an integral unit. The dust pan handle resides over the pan when locked in the retracted position, preferably over the center of, gravity, whereby when suspended by the gripping portion, the bottom of the scoop seeks a horizontal plane. Preferably, the handle is bent such that the gripping portion occupies a vertical line coinciding with the center of gravity, which arrangement has the further advantage of tilting the pan up on its leading edge when the assembly is locked in the extended position and rested on a surface.

9 Claims, 5 Drawing Sheets

BROOM DUSTPAN AND COMBINATION

CROSS-REFERENCE TO RELATED APPLICATIONS

This application is a continuation-in-part application of U.S. Patent Application Ser. No. 08/021,201, filed Feb. 23, 1993, now U.S. Pat. No. 5,367,737.

BACKGROUND OF THE INVENTION

1. Field of the Invention

The invention relates to a broom and dust pan combination for manual collection of debris, the dust pan having a handle attached to a scoop into which debris can be swept for disposal. In particular the invention concerns an improved dust pan and broom combination having a bracket attached to the rear of the pan for pivotally receiving an elongated dust pan handle and retaining a broom handle.

The dust pan handle is pivotable relative to the pan, between at least two positions where it detachably locks. In a first lock position the pan is substantially perpendicular to the handle for an upright user to sweep debris conveniently into the pan while holding the handle in one hand and a broom in the other. In a second lock position the dust pan is substantially parallel to the handle, enabling a shovel-like use of the assembly for lifting debris into a disposal container. The arrangement includes a broom receptacle having a clip for a broom handle and a channel in the pan adjacent the dust pan handle for unitary storage of the dust pan assembly and broom.

In one embodiment the handle of the pan has a distal part that is diverted from the proximal part at a point at or above the clip for the broom handle. The locking positions in this arrangement are such that when the handle is substantially perpendicular to the plane of the pan, the proximal part of the handle leans forward over the pan, allowing the pan to stand stable on a horizontal surface while providing a very conveniently manually manipulated dust pan, for use with a straight handled broom.

2. Prior Art

Dust pans are useful for cleaning in and about the home and commercial and industrial buildings. Dust pans typically have a broad shallow container or scoop attached to a handle, the scoop or container being open on one edge. The scoop is rested on the ground with the open edge against the ground and a broom or other implement is used to push dust or other debris over the edge and into the scoop. The scoop is then manipulated like a shovel, to lift and dump the debris into a receptacle.

Conventional home dust pans characteristically have a short handle which is rigidly mounted and protrudes from the rear of the dust pan scoop substantially in the same plane as the scoop. The user bends over to grasp the handle and/or must incline the dust pan at an angle to the floor, in order to place the edge of the scoop on the floor to gather dust. The user generally holds the broom with one hand, at a higher vertical position than the user holds the dust pan with the other hand.

A more "industrial" and quicker form of dust pan has an elongated handle that protrudes upwardly when the edge of the scoop is placed on the floor. The user holds the handle of the scoop with one hand, in opposition to a broom being manipulated with the other hand at close to the same vertical position as the first hand. Typically the handle is rigidly mounted perpendicular to the plane of the dust pan scoop and the scoop is open across its top.

It is also known for such a scoop to define a container having an open front at the edge of the scoop and a rear portion that is closed over the top of the scoop. The closed-rear form of scoop may swing freely on the handle on a pivot axis near the front of the scoop, such that the rear of the container drops downwardly when the scoop is lifted, capturing the debris.

Whether or not the :scoop is attached rigidly, the user of a dust pan with an upwardly extending handle does not have to bend over the dust pan to gather debris, and can proceed more quickly from place to place to sweep up. However, there are shortcomings in known dust pans having upwardly extending handles.

It is known in certain agricultural handtools to provide a pivoting junction for a tool head. For example, a multi-tined fork is known that can be set to extend straight from the handle for digging, or perpendicular to the handle for raking. This is a useful tool for cleaning out hay in stables, but the tines of course do not form a structure that is useful for capturing dust and small debris, and the tool itself is used to manipulate the hay, whereas a broom is used with a dust pan.

Where the handle is mounted rigidly perpendicular to the plane of the scoop, it is awkward for a user to dump, the scoop to empty the debris into a receptacle. The user must lift the dust pan over the edge of a container such as a trash can, and turn the pan to pour the contents out over the front or side edge. For example, the pan can be held over the receptacle as the handle is rotated around the open edge of the pan (to dump frontwards). In combination with this motion the handle can be rotated on its axis to dump wholly or partly over the side. The motions are awkward and may cause gathered debris to spill out of the dust pan prior to disposal.

Dumping a scoop that swings freely on its handle is also awkward. The user must lift the scoop over the edge of the receptacle, which causes the scoop to rotate such that its open end is up. The user; must rotate the scoop manually relative to the handle in a two-hand operation to dump the contents into the receptacle. Thus the user must put down the broom, often dropping the broom and requiring the user to bend over anyway.

Another problem is the difficulty in the display and merchandising of dust pans having upwardly extending handles, and in their compact storage. The pan portion of a rigidly attached arrangement necessarily extends laterally outward from the handle, taking up space in displays and in storage closets. When the dust pan assembly is hung, for example, on a vertical display wall in a store, the pan eliminates viewing space. The dust pan is difficult to remove from a storage closet if other stored items inadvertently accumulate on the pan.

The pan portion of a swinging arrangement is more compact if the device is hung by its handle (i.e., the container pivots down). However, this form of device will not stand upright without support, and falling over of the handle is a problem. The swinging nature of the device makes it unsuitable for the general object of using a dust pan as a form of shovel. Finally, the closed nature of the receptacle and the position of the pivot axis well forward of the rear of the scoop both limit the size of debris that can be collected.

It would be desirable to provide a dust pan arrangement, wherein the handle and dust pan scoop are pivotable, but also are arranged to lock selectively at particular positions which are most helpful for the user. The present invention is selectively arranged and locked at either of at least two locked positions. In one position the handle is substantially perpendicular to the dust pan scoop, for sweeping up debris while the handle/pan assembly is standing upright. In another position the handle is parallel to the plane of the scoop, for shovel-like operation during pickup or dumping. The scoop preferably extends away from the handle in the parallel position, minimizing the space occupied in storage or display. A channel including clamping means on the dust pan handle and/or the dust pan accommodates the handle of a broom. The broom head rests in the scoop, providing an integral unit for storage, display and transport.

It is possible to structure the dust pan assembly such that the handle is arranged precisely perpendicular to the plane of the pan in one of the positions. However, according to a further aspect of the invention, the handle can be inclined somewhat over the pan, and provided with a diverted distal end portion that extends vertically. Such a dust pan is easily manipulated manually with one hand on the handle and the other on the broom, and is also more stable than a straight vertical handle in that the center of gravity of the handle is over the pan instead of at its rear edge.

SUMMARY OF THE INVENTION

It is an object of the invention to provide a dust pan assembly with a selectively locked hinge joint between a dust pan handle and scoop, whereby the dust pan is configured for alternative situations.

It is another object of the invention to provide a pivoting dust pan scoop and handle, that pivots substantially 90° around a pivot axis adjacent a rear of the scoop.

It is another object of the invention to provide a pivoting dust pan scoop and handle arranged to lock the scoop at least at two positions relative to the handle, including a substantially perpendicular and a substantially parallel position.

It is another object of the invention to provide a locking hinged dust pan that durable, inexpensive, and easy to merchandise, display, transport, store and use.

It is another object of the invention to provide a pivoting and locking dust pan assembly as described, with mounting means to fix a conventional broom to the dust pan assembly to form an integral unit.

It is a further object to provide a broom and dust pan assembly as described, wherein the handle of the dust pan is optimally configured for stability and manual manipulation.

These and other objects of the invention are met by a dust pan construction with a selectively lockable hinged joint. The dust pan has a pan-shaped base member having three side walls and an open front scoop or blade portion over which debris is scooped or swept. Preferably the scoop is open at the top, and pivotally attached to the handle on an axis at the rear of the scoop. A bracket for the handle is integrally formed in or attached to the rear wall of the pan-shaped scoop, and forms a pivot joint and lock for the scoop and handle portion relative to one another.

The bracket preferably forms a U-shaped channel having a base and two spaced facing surfaces extending from the bracket base. The bracket defines an interior cavity receiving the end of the handle. The two spaced bracket surfaces can extend perpendicular to the rear wall of the pan-shaped scoop or base member, defining an unrestricted rear portion to allow pivoting of the handle in the bracket between a position substantially parallel to the plane of the scoop and a position substantially perpendicular to the scoop. The two spaced sidewalls have an axial bore carrying a pivot pin that extends through a transverse bore in the end of the handle, which is elongated for grasping by a standing user in the perpendicular position. At least one of the two spaced sidewalls includes at least two locking detents for fixing the handle in the two positions.

The detents preferably are formed by at least two bores spaced radially from the pivot axis by an equal distance, defining female locking means for receiving a movable locking pin associated with the handle. The handle has at least one transverse depressible member such as a spring loaded pin, at a corresponding distance from the pivot axis. The pin defines male locking means aligned with the bracket female locking means of the detent.

The locking positions of the pivoting handle relative to the dust pan defines at least two positions, a substantially perpendicular position for sweeping debris into the dust pan and a substantially parallel position for disposing of the gathered debris in a shovel-like manner and also for optimal storage and optimal display.

The broom and dust Fan combination may also include means on the handle and/or the hinged bracket to receive a broom in a compact arrangement wherein the broom and the dust pan arrangement are preferably attached. This is particularly advantageous for compact storage and display, with the broom head placed in the scoop, and the scoop arranged parallel to the handle. A clamp for the broom handle preferably is disposed on the dust pan handle at a distance from the scoop. The rear wall of the scoop may include a top indentation in which the clamped broom nests.

More particularly, the dust pan has a rear wall, and the rear wall has a substantially U-shaped rearwardly extending portion and having pivot means attached to the dust-pan handle. The substantially U-shaped rearwardly extending portion is particularly adapted to receive and frictionally retain the cylindrical broom handle of the broom.

It is also preferable if the dust-pan handle is shaped for balancing the dust pan for carrying waste debris. For instance, the dust pan handle may have proximal (lower) and distal (upper) straight sections joined at a middle curved section. The dust pan handle is coupled to the bracket, with a bottom end arranged in the handle-receiving cavity to pivot on the pivot means and a top portion defining a gripping portion. The detent arrangement coupled between the bracket and the handle defines at least two locked positions for the handle, one being an extended position and the other a retracted position, respectively. With the curved handle, the dust pan assembly is balanced such that, when the dust-pan assembly is locked in the retracted position and suspended by the gripping portion, the bottom of the scoop seeks to level with a horizontal plane and remains quite stable when rested on a horizontal surface.

For this purpose, the handle, and more particularly the bend of the middle section of the handle, can be arranged such that the upper straight section occupies a line or axis extending perpendicularly through a center of geometry of the bottom of the scoop, when the handle is locked substantially perpendicular to the plane of the scoop. When the handle is pivoted to parallel with the plane of the scoop, and a straight broom handle is affixed at the receptacle provided, the lower or proximal section rests against the broom handle and the upper or distal section is bent or diverted away from the handle, toward the side of the bottom of the scoop.

These and other advantages of the invention will become more apparent in connection with the following description of certain embodiments of the invention disclosed as non-limiting examples.

BRIEF DESCRIPTION OF THE DRAWINGS

There are shown in the drawings the embodiments of the invention as presently preferred. It should be understood that the invention is capable of embodiment in a member of specific arrangements in accordance with this disclosure, and reference should be made to the appended claims rather than the discussion of exemplary embodiments to assess the scope of the invention in which exclusive rights are claimed. In the drawings.

DETAILED DESCRIPTION OF THE PREFERRED EMBODIMENTS

Although certain specific terms describing shapes, directions and the like are used in the following description for the sake of clarity, these terms are intended to assist in the understanding of the particular structure of the invention selected for exemplary illustration, and are not intended to define or limit the scope of the invention.

Figure 1:
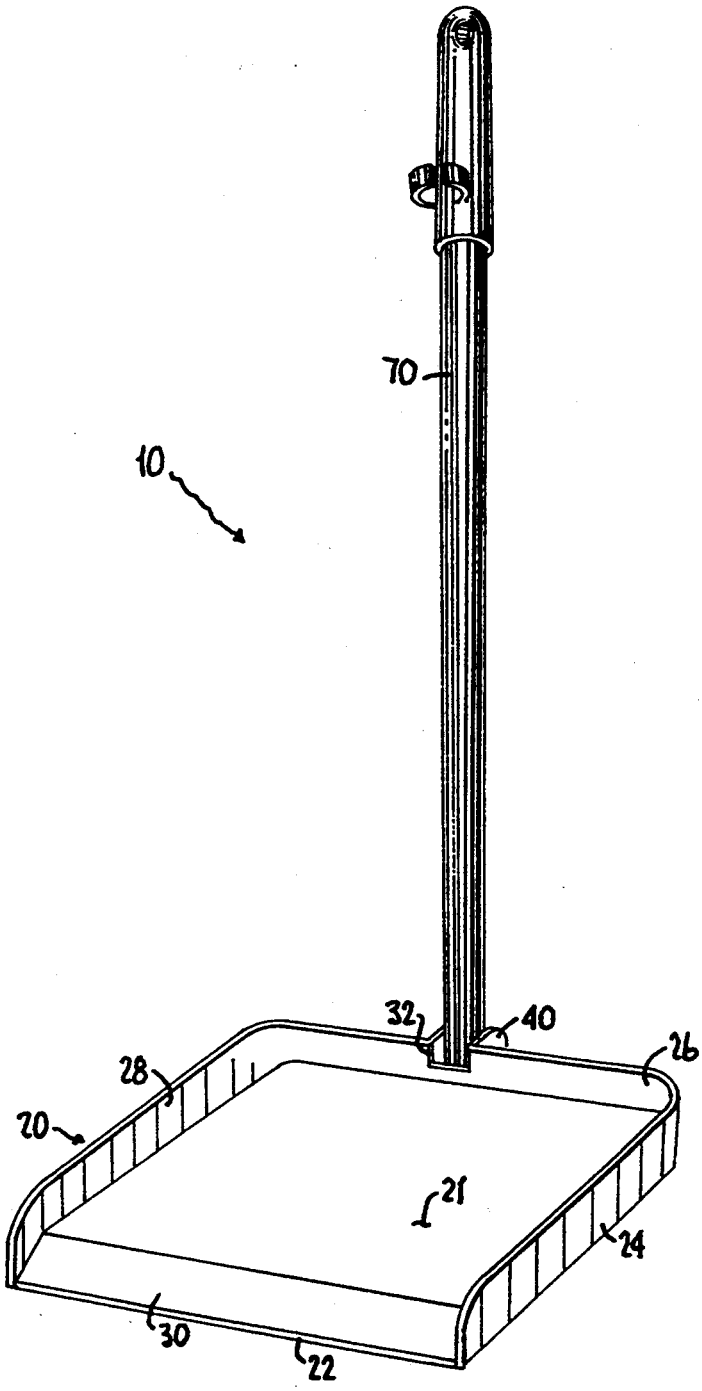
FIG. 1 is a perspective view of the locking hinged dust pan according to the invention.
Figure 2:
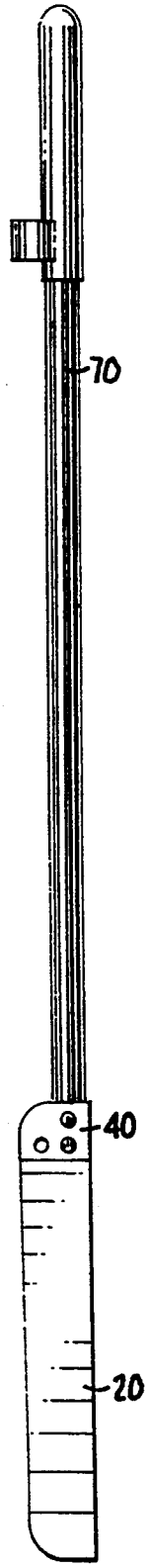
FIG. 2 is a side view of the locking hinged dust pan.

An exemplary embodiment of the dust pan construction 10 according to the invention is shown generally in FIGS. 1 and 2. The dust pan comprises a pan-shaped scoop or base member 20, a bracket 40, and a dust pan handle 70, whereby the dust pan base member and the handle ;are operatively connected. The dust pan is operated in known manner when configured as shown in FIG. 1, i.e., for use by a standing person holding the handle 70 in one hand and a broom (not shown in FIG. 1) in the other hand. The user urges debris over the edge or blade 22 of the scoop, collecting the debris on the bottom surface 21 Until it is convenient to dump the debris. The dust pan is operated more like a shovel or push scoop when configured as shown in FIG. 2, which is convenient for loading a quantity of debris into a receptacle or the like. Additionally, in the configuration of FIG. 2, the dust pan arrangement is rendered compact for storage, transport or display.

The pan-shaped base member 20 has a generally planar body that extends laterally from the longitudinal axis of the handle 70 and has an open top. The base member 20 has an inner bottom surface 21 leading to an open front scoop or blade portion 22. Three shallow perpendicular walls 24, 26, 28, extend upwardly from and around three side of the bottom surface 21, forming a walled enclosure for confining debris within the partially enclosed base member. The debris is confined so long as the scoop is not tilted forward, or tilted in another direction sufficient to allow the debris to pass over one of the walls.

The dust pan base member 20 has a lateral width of convenient size to collect debris therein, for example being slightly wider than the broom with which it is used. A preferred width is about one foot or 30 cm. The dust pan base member 20 has a length from front to rear of a suitable size to contain a substantial amount of gathered debris, e.g., about 8 inches or 20 cm. As noted hereinafter, the dust pan member is preferably large enough to encompass the head of a broom in a unitary storage arrangement. Accordingly, the length, width and depth of the base member in that case are made at least as large as the corresponding dimensions of the broom head. Preferably the length and width are a few centimeters larger than the broom head and the depth is about the same as the thickness of the broom head, e.g., 2 to 4 cm.

The open front scoop portion 22 is configured for easy flow of debris over the scoop portion and into the dust pan when placed on a horizontal surface, such as a floor. The open front scoop portion may be tapered at its terminal edge to define a ramp or incline 30 such that debris may be swept from a horizontal surface, such as a floor, into the pan-shaped base member 20 more efficiently.

The bottom surface 21 may also be tapered or inclined downward from the front to rear, defining a well such that retains the gathered debris accumulated in the pan-shaped base member 20 as the dust pan is carried around.

The dust pan-shaped base member 20 can be molded of plastic material such as polyethylene or polypropylene. The dust pan-shaped base member is preferably of lightweight construction, and alternatively can be made of sheet metal.

As shown generally in FIGS. 1 and 2, a bracket 40 is coupled to the pan-shaped base member 20 and is arranged to receive the bottom end of the dust pan handle 70. Bracket 40 is part of a pivotable coupling between the handle and the dust pan base member whereby the two can be moved between the perpendicular and collinear positions shown respectively in FIGS. 1 and 2, and locked in the chosen position. It is also possible to arrange for locking at additional angles. At least the two positions shown are preferred.

Figure 3:
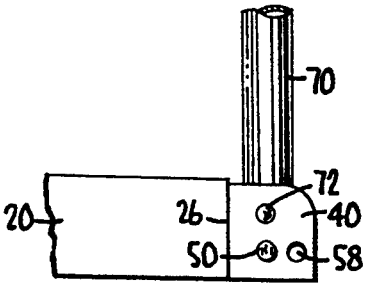
FIG. 3 is a side view of the locking hinged bracket in a substantially perpendicular locking position.
Figure 4:
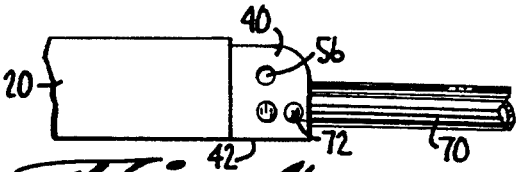
FIG. 4 is a side view of the locking hinged bracket in a substantially parallel locking position.
Figure 5:
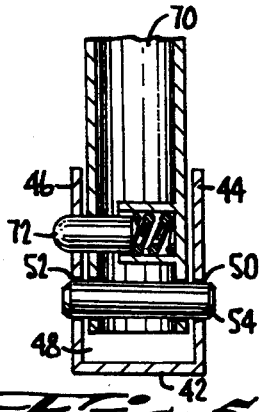
FIG. 5 is a front cross-sectional view of the locking hinged bracket.

Bracket 40 is shown in more detail in FIGS. 3–5. The bracket 40 preferably is formed integrally with the material of the dust pan scoop or base portion, but could comprise a U-shaped member that is attached to the base portion 20. Bracket 40 also may have laterally protruding ears (not shown) for attaching bracket 40 on the rear wall 26 and/or better supporting the joint with the handle. The bracket is rigidly fixed to base portion 20 and encompasses the end of handle 70 as shown in FIG. 5. A similar bracket can be formed in other particular ways, for example using two spaced angle brackets straddling the handle and attached at the rear of the base portion 20. In any event, base member 20 and handle 70 are pivotally coupled via the bracket 40 or the like, on a pivot axis transverse to the handle and parallel to the rear wall of the base portion 20. The bracket 40 comprises a generally planar base 42 and two spaced parallel surfaces 44, 46 extending upwardly from opposite sides of the base 42, thereby defining an interior space 48 along the distance of the two oppositely faced parallel surfaces. The interior space 48 defines a receptacle for receiving a standard dust pan handle 70 along the longitudinal axis at the bottom end of the handle.

The parallel surfaces 44, 46 have aligned bores 50, 52 along the pivot axis for handle 70. A shaft or pivot pin 54 is coupled between surfaces 44, 46 through a bore near the bottom end of the handle. Pin 54 may be a metal pin that is swaged or otherwise fixed so that it cannot escape axially from bores 50, 52. Alternatively, a plastic hinge pin can be fixed to the bracket by adhesive, heat welding, etc. other specific pivot connections also may be used.

The bracket 40 is coupled to the rear wall 26 of the dust pan base member 20, with the parallel surfaces 44, 46 of the bracket extending perpendicularly rearward to encompass the handle 70. Preferably, the bracket 40 is integrally formed in the dust pan base member 20. The mounting arrangement restricts the pivot axis to a substantially 90° pivot range. The rear perpendicular wall 26 of the dust can base member defines an abutment for the handle at 90° and the base 42 of the bracket defines an abutment for the handle at 0°. Thus, in the embodiment shown the handle 70 is limited to rotate only about 90° relative to the dust pan base 20, between the positions shown in FIGS. 1 and 2. Additionally, a detent arrangement is provided such that when rotated to the selected position the base member and handle remain locked.

The bracket 40 includes at least two locking means 56, 58 arranged for setting the joint to the selected angle. The locking means preferably fix the angle rigidly, but it is also possible to envision a resilient detent arrangement whereby the locking means can be overcome with sufficient force. In the embodiment shown in FIG. 4, the locking means interact with a lateral pin 72, that can be manually depressed for rotating the handle 70 relative to the base 20, or allowed to drop into one of the locking means 56, 58, whereupon the joint is rigidly locked.

Locking means 56 define a locked position in which the handle 70 is substantially perpendicular to the dust pan scoop or base member 20. In this position a user can operatively place the dust pan portion 20 along a horizontal surface such as a floor, while holding the elongated handle 70 with one hand in an upright stance. The user's free hand, for example, is used to sweep gathered debris with a broom into the dust pan assembly for collection.

Locking means 58 define the second locked position in which the handle 70 is substantially parallel to the dust pan shaped base member 20. This substantially parallel position permits a user to manipulate the dust pan in the manner of a shovel. For example the second position can be used to lift debris from a pile into a trash can, dumpster or other receptacle, or perhaps to use the device as a dust pan while bending over, or when cooperating with another person who operates a broom. The shovel arrangement is relatively more efficient than the perpendicular configuration for disposing of debris into a disposal receptacle, because it is much easier to prevent substantial loss of the debris from the dust pan, e.g., over the shallow sides.

The parallel locking position also permits compact storage of the dust pan assembly. In the parallel position the dust pan can be stored, for example, in a storage closet, occupying a much smaller horizontal area than when in the perpendicular position. The parallel position is similarly useful for a merchandiser to display dust pan assemblies in a compact manner for sale, for example by stacking them horizontally or vertically, or by hanging them on a display wall. This arrangement is compact because the dust pan portion 20 resides in the same plane as the handle 70.

Locking means can be provided on either or both of the parallel surfaces 44 or 46 of the bracket. The oppositely faced parallel surface 44 and/or 46 thus may include at least two locking bores 56,58 at the same radial space from the pivot axis, defining female locking means for receiving a spring loaded locking pin 72, only one locking pin and one set of locking holes, 56, 58 being shown in FIGS. 3, 4 and 5.

The elongated handle 70 can be about a meter in length. Handle 70 can be solid or hollow, and as shown in FIG. 5 is hollow. The handle is pivotally connected to the bracket by pin 50, and pivotally fixable by spring pin 72 that is carried in a supporting tube. Pin 72 is urged outwardly by a compression spring and has a shoulder that bears against the inside of the hollow handle to retain the pin in the handle at its maximum extension. Pin 72 defines a male locking means 72 at a distance from the pivot connection equal to that of female locking holes 56, 58 in the bracket.

Depressing spring-loaded pin 72 disengages the locking means, permitting relative rotation of the handle and base around pivot pin 50. When the pin 72 then aligns with one of holes 56 and 58, the pin protrudes and the arrangement locks. This form of locking means is simple and durable, although other conventional locking means may be used for a similar function.

Figure 8:
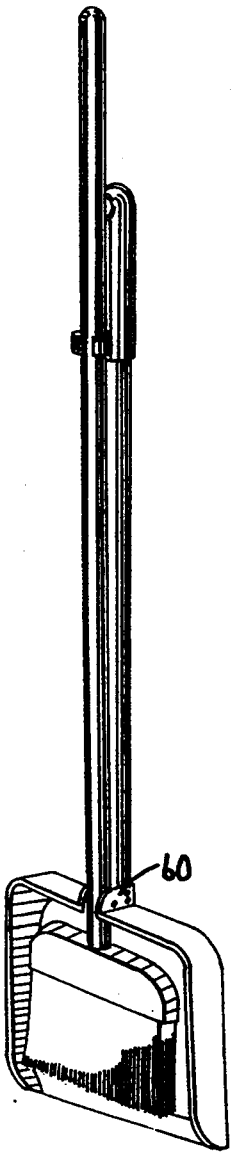
FIG. 8 is a perspective view of a first embodiment of a dust pan and broom combination of the invention.

As shown in FIGS. 6–8 and 14, the handle 70 may include a hook or through hole 74 near its top end, for hanging the dust pan during storage or display. The elongated handle 70 may further include a clamping means 76 positioned on the front portion the handle 70 and arranged to removably attach a conventional broom handle to the front of the dust pan arrangement. The dust pan handle 70 and handle of broom 80 are of substantially the same diameter. The attached broom 80 and dust pan form an integral cleanup kit or unit for storage and display. The two surfaces 44, 46 of the bracket 40 can be elongated at their top portions to define a second clamping means 60 for attachment near a lower end of a broom handle when the dust pan is positioned in the parallel position for storage or display as shown in FIG. 8. When in the perpendicular position, only the upper clamp is used to engage the broom handle.

The rear wall 26 of the dust-pan shaped base member 20 preferably has an indentation 32 in the top of the rear wall 26 at the coupling with bracket 40. This indentation provides a space where the handle of a broom 80 held on the dust pan assembly can nest. The broom head thus can be placed in the pan-shaped base member 20 instead of resting against the top edge of the rear wall 26, making the arrangement even more compact. The lateral Width of the dust pan-shaped member 20, the length from lip 22 to wall 26, and the height of the sidewalls, are all of suitable size to accommodate the broom head of the clamped broom assembly in the volume encompassed by the pan-shaped base member 20.

Figure 6:
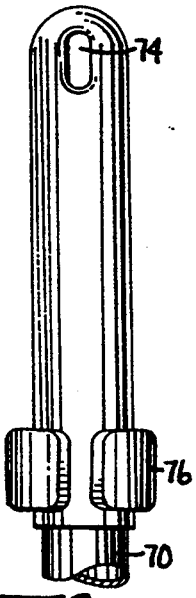
FIG. 6 is a perspective view of the elongated handle having clamping means.
Figure 7:
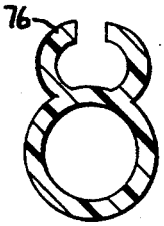
FIG. 7 is a perspective view of the clamping means.

The upper clamp 76 can be formed integrally with a grip that fits over the end of handle 70 as shown in FIG. 6. The grip also can be the site of the hanging hole 74. Alternatively, the attachment structures for affixing the broom handle to the dust pan assembly can be disposed on the broom handle rather than on the dust pan, with similar results.

Figure 14:
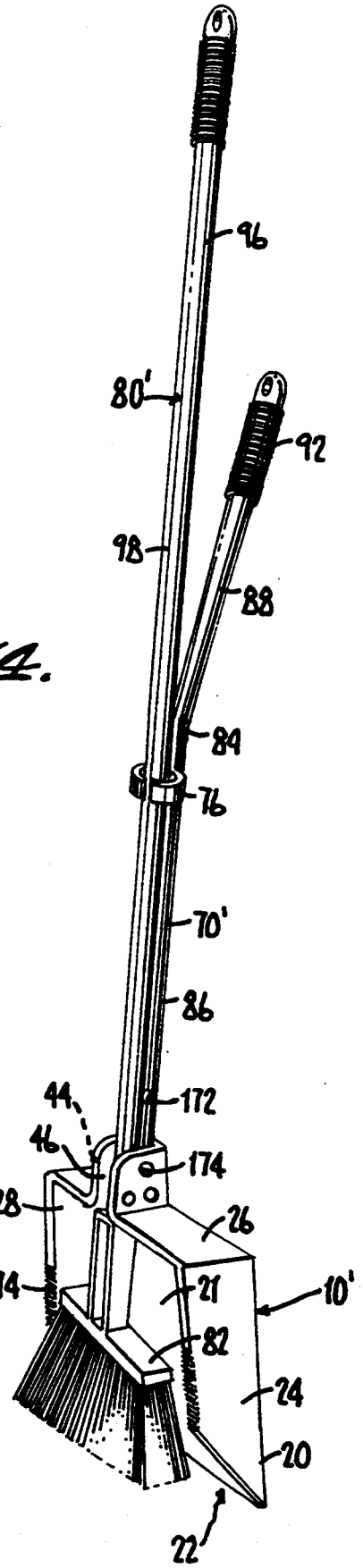
FIG. 14 is a perspective view of a second embodiment of a dust pan and broom combination of the invention.
Figure 15:
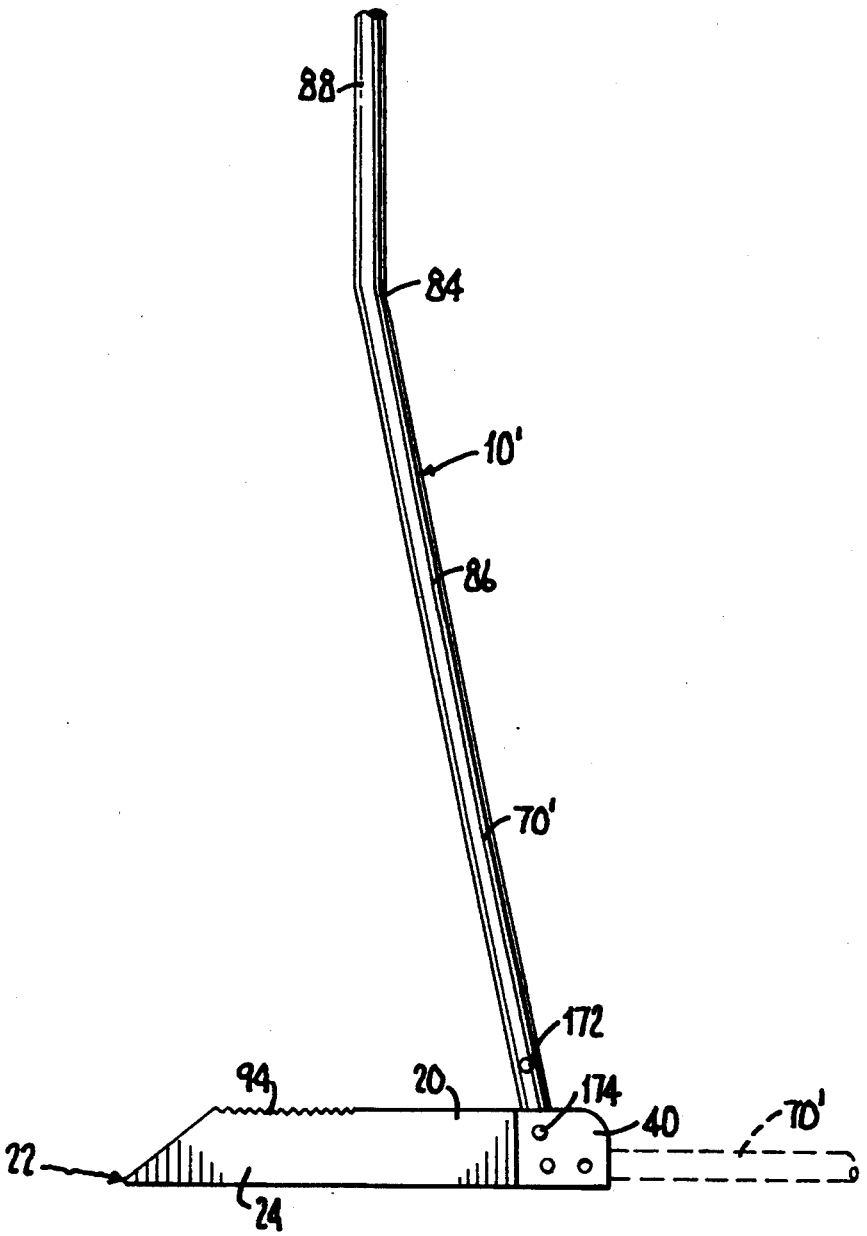
FIG. 15 is a side view of the dust pan in FIG. 14, wherein the handle is locked in a pivoted position.

FIGS. 14 and 15 show a particularly advantageous embodiment of the dust pan 10′ and the broom 80′. If the broom 80′, the broom block 82 is shaped as is more particularly disclosed in commonly-owned, commonly-invented U.S. patent application Ser. No. 08/012,501 filed Feb. 2, 1993, now U.S. Pat. No. 5,371,916 which is hereby fully incorporated. In the dust pan 10′, among other differences, the scoop 20 has taller sidewalls 24, 26 and 28, and the handle 70′is curved. The curve in the handle is such that the upper section 88 of the handle is disposed over the pan 10′ at a point forward of the pivot axis when the handle is pivoted as in FIG. 15, and preferably the handle end is vertical and centered. When the handle is straight along the plane of the pan as in FIG. 14, when the dust pan is laid on a surface, the handle forms an arch that tilts the pan to bring the open front edge of the pan directly against the surface for collection of debris while minimizing the extent to which debris may be swept under the pan.

In the embodiment shown, handle 70′ has a curved section 84 between two straight sections 86 and 88. The lower one 86 of the straight sections 86 and 88 is pivotally mounted to the bracket 40 in the scoop 20 and the upper straight section 88 terminates in a gripping portion 92 formed with a loop. It would also be possible to have the handle more generally curved, but as shown in FIG. 14, the arrangement shown stores very compactly with a broom having a straight handle.

Figure 9:
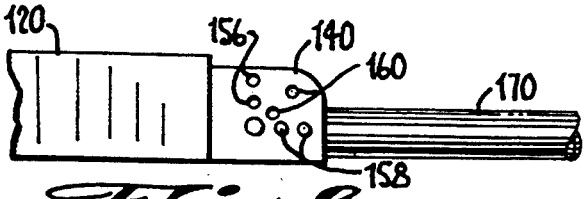
FIG. 9 is a side view of an alternative embodiment of the locking hinged bracket in a substantially parallel locking position.

The dust pan handle 70′ is positionable at least between an extreme extended position and a retracted position, which can be about 100° angularly spaced, whereby the lower handle section leans out over the pan in the retracted position by about 10° from vertical. The handle likewise is bent around a corresponding angle so that the upper handle section is vertical for easy manipulation as shown in FIG. 15. The retracted position as in FIG. 15 (hereinafter, the "retracted" position) is characterized by the lower straight section 86 being pivoted about 100° (counterclockwise in FIG. 15) relative to the extended position shown in FIG. 14. The extended position of the dust pan 10′ as laid on a horizontal surface is substantially as shown in FIG. 9, but due to the bend, the pan 10′ becomes tilted as compared to FIG. 9.

The bent handle 70′ is shaped and arranged to provide various advantages while the dust pan 10′ is locked in the retracted position. The bottom 21 of the scoop 20 generally defines a supporting surface for the dust pan and has a center of gravity more or less in the center of its outline in plan view. The upper straight section 88 defines an axis (not shown) which, when the dust pan 10′ is locked in the retracted position, intersects the bottom 21 perpendicularly through the center of gravity.

By this arrangements of the bent handle 70′, the retracted dust pan 10′ balances stably when stood, scoop down and handle up, on a level surface (FIG. 15). That is, the scoop 20 of the retracted dust pan 10′ sits on the level surface as the bent handle 70′ extends generally upwardly. The bent handle 70′ does not destabilize the balance of the retracted dust pan 10′, and indeed promotes stability because the upper straight section 88 defines an axis that extends perpendicularly through the center of the bottom 21.

The arrangement is also more apt to retain dust in the retracted position when carried loosely by the gripping portion 92, because when the center of gravity is under the handle, the pan remains substantially horizontal. By comparison, with a simple right angle pan as in FIG. 1 carried loosely by the handle, if the center of gravity of the pan is not under the handle, the handle leans in a direction that would enable debris to spill out over the front edge. The bent handle of FIGS. 14 and 15 avoids this condition, and as a result is more readily manipulated by the user, who is not required to exert a lateral force on the handle to keep the pan from tilting when carried.

In use, a user locks the dust pan 10′ in the retracted position, in preparation of standing the dust pan 10′ or a ground surface. After that, the user can let go of handle 70′, and the dust pan 10′ stands stable and upright on its own. The user can step lightly on the scoop 20 (for instance on the toothy tread 94), to hold scoop 20 stationary while using two hands to manipulate the broom 80′ sweep material into the scoop 20, over the front edge 22, onto the bottom 21, and back against the rear wall 26.

The user can also step on the back wall to tilt the pan slightly after sweeping in the debris, and the pan still remains stable at least up to the angle of the bend in the handle. The right angle arrangement of FIG. 1, by comparison, is likely to teeter over and spill out the material. To avoid this situation, the user can grasp the handle before stepping off the scoop.

According to another alternative (not shown), the handle can be straight but arranged to tilt over the: center of gravity of the dust pan in the retracted position. This does not place the gripping portion 92 at a comfortable angle for carrying. The bent handle 70′ according to FIGS. 14 and 15 the invention solves the stability disadvantages of a right angle retracted position, comfortably. Moreover, in the extended position, the bent handle 70′ also places the leading edge of the pan positively against the ground in the manner described above.

The precise center of gravity relationship and the comfort and balance of dust pan 10′ of course varies with whether the scoop 20 is loaded with material or not, and with the weight of the material. If the scoop 20 is empty and therefore at its minimum stability, the handle 70′ and dust pan 10′ are balanced such that bottom 21 seeks to level with the horizontal. Heavier material that is not distributed evenly in pan 10' may tend to urge the bottom 21 to tilt, but material that is swept to near the rear of the pan urges bottom 21 to tilt in a direction that would raise front edge 22 relative to the rear edge of the bottom 21 (i.e. along rear wall 26) making it less likely that the material will spill out over the front edge 22.

If it is expected that the dust pan will often hold heavy material, the handle can be bent and inclined to place the gripping portion 92 forward of the center of gravity of the pan when empty. However, in each case the gripping means is placed such that it is forward of the pivot axis and normally is closer to the center of gravity than the pivot axis.

The detent arrangement 172 and 174 in the FIG. 14 embodiment is changed such that the manually depressible pin 172 is spaced further from the shear pin 174. The manually depressible pin 172 is hence removed from any possible interference with the pivoting of the bracket 40. This location is advantageous for dumping material in a dust bin (or like receptacle).

In use, the user loads the scoop 20 with material and carries the dust pan 10' to a position over a dust bin. The material is stably carried in the scoop 20 because the dust pan 10' is balanced by design for that purpose. The bottom 21 either seeks to level with the horizontal, or seeks to tilt at an angle of inclination such that the front edge 22 tips up, thereby tending to displace material back away from the front edge 22.

Once the user has the dust pan 10' positioned over a trash can or the like, he or she can tilt the pan to dump it or can release the detent arrangement to the extended position and thereby drop the load. To do this, the user can simply hold the dust pan 10' in one hand by the grip 92 While depressing the pin 172 with his or her free hand. The retraction of the shear pin 174 unlocks the scoop 20 from being locked in the retracted position. Hence, the scoop 20 is free to pivot such the front edge 22 drops downward. More accurately, the scoop 20 pivots toward the extended position (shown in FIG. 14), permitting the material to dump out, and into the dust bin.

Turning now to the releasable mating between the broom 80' and dust pan 10', the broom 80' has a cylindrical handle 96 defining an outer periphery 98. The dust pan 10' and broom 80' are releasably matable together, partly by means of the clip or clamping mechanism 76. The clip or clamping mechanism 76 grips the broom handle 96 by the outer periphery 98. The scoop 20 cooperatively provides a second mechanism for releasably clamping the broom handle. For this purpose, the scoop 20 and the bracket 40 are selectively formed with the opposed surfaces 44 and 46, which define opposed bearing surfaces. The opposed bearing surfaces 44 and 46 are selectively spaced and arranged for frictionally engaging the outer periphery 98 of the broom handle 96. By this arrangement, the need for a second clip is eliminated because its work is performed by the opposed clamping surfaces 44 and 46 of the scoop and bracket 20 and 40. Thus the broom 80' and dust pan 10' are releasably mated by the broom handle 96 being frictionally engaged at spaced positions, as at position, 76 and 44/46.

Figure 10:
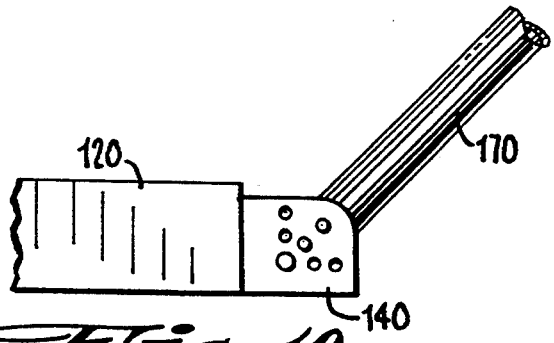
FIG. 10 is a side view of the alternative embodiment of the locking hinged bracket in a locking position between substantially parallel and substantially perpendicular.
Figure 11:
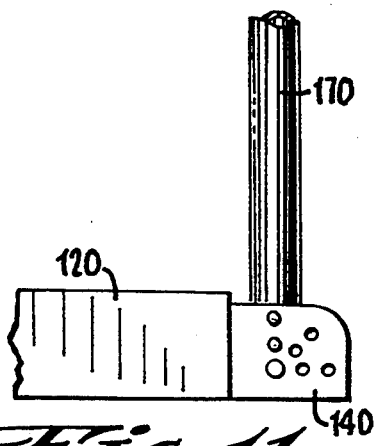
FIG. 11 is a side view of the alternative embodiment of the locking hinged bracket in a substantially perpendicular locking position.

An alternative embodiment is shown generally in FIGS. 9, 10 and 11 where a bracket 140 is coupled to a pan-shaped base member 120 and is arranged to receive the bottom end of a dust pan handle 170. Bracket 140 is pan of a pivotable coupling between the handle and the dust pan base member whereby the two can be moved between perpendicular and collinear positions and locked in any chosen position.

In this embodiment As shown in FIGS. 9, 10 and 11, the bracket 140 can include at least three locking means 156, 158 and 160 which interact with two spaced lateral pins, 172, 174 wherein depressible pin 172 can be manually depressed to release additional locking pin 174 for rotating the handle 170 relative to the base 120, or allowed to drop into one of the locking means 156, 158, 160, whereupon the joint is rigidly locked. Each of the locking i, means can include at least two linearly spaced locking bores for each locking position which are radially spaced apart from each other along the pivot axis.

Figure 12:
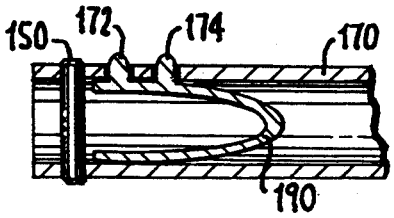
FIG. 12 is a front cross-sectional view of an alternative embodiment of the locking hinged handle.
Figure 13:
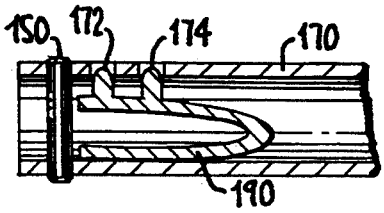
FIG. 13 is a front cross-sectional view of the alternative embodiment of the locking hinged handle.

In this embodiment as shown in FIGS. 12 and 13, the elongated handle 170 can be pivotally connected to the bracket 140 by pivot pin 150, and pivotally fixable by resiliently biasing pins 172, 174 that are mounted in the handle tube on a flexible member 190. The flexible member 190 laterally biases the pins 172, 174 to protrude through two bores in the handle tube wall to thereby engage the locking means on the bracket 140. In addition, a plurality of locking means (not shown) can be provided on the to pivotally fix a handle relative to the dust pan base at any position along the pivot axis.

The invention having been disclosed, variations and additional embodiments in accordance with the invention will now be apparent to persons skilled in the art. Whereas the invention is not intended to be limited to the exemplary embodiments and will encompass a range of such variations, reference should be made to the appended claims rather than the foregoing specification to asses the scope of the invention in which exclusive rights are claimed.

We claim:

1. A combination of a broom and dust pan, the combination comprising:

the broom having a cylindrical handle;

the dust pan having a handle and having a bottom, an open front scoop portion and three walls extending upwardly from the bottom two of said three walls terminating at the open front scoop portion;

one of the three walls having a substantially U-shaped portion and the substantially U-shaped portion having pivot means attached to the dust-pan handle, the substantially U-shaped portion also adapted to receive and frictionally retain the cylindrical handle of the broom.

2. The combination of claim 1 in which the broom has a broom head carrying bristles, wherein the broom head and bristles are retained within the three walls of the dust pan.

3. The combination of claim 1 in which the dust-pan handle is curved.

4. The combination of claim 1 in which the dust-pan handle is straight.

5. The combination of claim 1 in which the dust-pan handle has a hand grip portion having an opening for hanging the combination from a hanger.

6. The combination of claim 5 in which the dust-pan handle has a clip member, between the hand grip portion and the dust-pan, adapted to frictionally hold a periphery of a portion of the cylindrical-broom handle.

7. The combination of claim 1 in which the dust pan handle and the broom handle are of substantially the same diameter.

8. A dust pan assembly, comprising:

a base member generally defining a pan with an open front, the base member having a bottom, an open front scoop portion, and three walls extending upwardly around the bottom, two of said three wall terminating at said open front scoop portion;

a bracket on one of the walk, remote from the open front scoop portion, said bracket having a pair of spaced opposed surfaces defining a handle-receiving cavity therebetween;

pivot means coupled to the bracket defining a pivot axis parallel to the one wall with the bracket;

an elongated handle coupled to the bracket and having a bottom end arranged in the handle-receiving cavity to pivot on the pivot means, said elongated handle further having a top portion defining a gripping portion;

a detent arrangement coupled between the bracket and the handle, the detent arrangement defining at least two locking positions around the pivot axis, releasably locking the handle in an extended position and a retracted position, respectively;

wherein in one of the two locking positions the handle is disposed closer to the center of gravity of the base member than is the pivot axis; and, wherein the handle extends from the base member while locked in the retracted position such that the dust-pan assembly is stable while standing on a level surface.

9. A dust pan assembly, comprising:

a base member generally defining a pan with an open front, the base member having a bottom, an open front scoop portion, and three walls extending upwardly around the bottom, two of said three walls terminating at said open front scoop portion;

a bracket on one of the walls remote from the open front scoop portion, said bracket having a pair of spaced opposed surfaces defining a handle-receiving cavity therebetween;

pivot means coupled to the bracket defining a pivot axis parallel to the one wall with the bracket;

an elongated handle coupled to the bracket and having a bottom end arranged in the handle-receiving cavity to pivot on the pivot means, said elongated handle further having a top portion defining a gripping portion;

a detent arrangement coupled between the bracket and the handle, the detent arrangement defining at least two locking positions around the pivot axis, releasably locking the handle in an extended position and a retracted position, respectively;

wherein in one of the two locking positions the handle is disposed closer to the center of gravity of the base member than is the pivot axis;

wherein the handle is inclined over the dust pan assembly and includes the gripping portion disposed substantially over the center of gravity in said one of the two locking positions, whereby when the dust-pan assembly is suspended by the gripping portion, the bottom seeks to balance in an orientation in which the bottom is oriented substantially horizontally;

wherein the handle comprises a lower section joined to an upper section along a bend, wherein the gripping portion is arranged on the upper section and wherein the upper section occupies a vertical axis that substantially intersects the center of gravity; and, wherein the handle is curved such that in the other of said two locking positions the dust pan assembly can be rested on a surface by the handle and the front scoop portion, with the base member inclined.

* * * * *